US006895607B2

(12) United States Patent
Idota et al.

(10) Patent No.: US 6,895,607 B2
(45) Date of Patent: May 24, 2005

(54) WESTERN-STYLE WATER CLOSET

(75) Inventors: Takanori Idota, Aichi (JP); Junjiro Ebitani, Aichi (JP); Toshio Hino, Aichi (JP); Toshiaki Matushita, Aichi (JP); Katsunori Tomita, Aichi (JP); Takashi Minami, Aichi (JP); Masahiro Iguchi, Aichi (JP)

(73) Assignee: Inax Corporation, Tokoname (JP)

( * ) Notice: Subject to any disclaimer, the term of this patent is extended or adjusted under 35 U.S.C. 154(b) by 0 days.

(21) Appl. No.: 10/296,200

(22) PCT Filed: May 18, 2001

(86) PCT No.: PCT/JP01/04232

§ 371 (c)(1),
(2), (4) Date: Nov. 29, 2002

(87) PCT Pub. No.: WO01/92653

PCT Pub. Date: Dec. 6, 2001

(65) Prior Publication Data

US 2003/0126677 A1 Jul. 10, 2003

(30) Foreign Application Priority Data

Jun. 1, 2000 (JP) ..... 2000-164153
Jun. 21, 2000 (JP) ..... 2000-186608
Jun. 21, 2000 (JP) ..... 2000-186610

(51) Int. Cl.[7] ..... E03D 9/08

(52) U.S. Cl. ..... 4/420.4; 4/420.1; 4/420.5; 4/448; 4/443

(58) Field of Search ..... 4/420.4, 420.1, 4/420.2, 420.3, 420.5, 422, 423, 447, 448, 446, 443, 444

(56) References Cited

U.S. PATENT DOCUMENTS 2,947,850 A 8/1960 Reilly
4,628,548 A * 12/1986 Kurosawa et al. ..... 4/420.4
4,860,178 A 8/1989 Picon
5,421,039 A * 6/1995 Hirashiba et al. ..... 4/420.2
5,647,069 A * 7/1997 Han et al. ..... 4/420.2
6,178,568 B1 1/2001 Boulieris
6,675,399 B1 * 1/2004 Tomita et al. ..... 4/420.4

FOREIGN PATENT DOCUMENTS

| | | |
|---|---|---|
| EP | 0 475 232 | 3/1992 |
| FR | 2 186 039 | 1/1974 |
| JP | 1-223232 | 9/1989 |
| JP | 8-105096 | 4/1996 |
| JP | 8-338056 | 12/1996 |
| JP | 2000-33051 | 2/2000 |

OTHER PUBLICATIONS

JPO Machine Translation of JP Pub 2000–033051 (App 10–203834); Feb. 2, 2000.*

* cited by examiner

*Primary Examiner*—Henry Bennett
*Assistant Examiner*—Amanda Wieker
(74) *Attorney, Agent, or Firm*—Oblon, Spivak, McClelland, Maier & Neustadt, P.C.

(57) ABSTRACT

The present invention provides a western-style flush toilet in which the performance of a component which constitutes a function device is not damaged, and simultaneously, the cleaning performance of a western-style toilet body can be surely improved. The western-style flush toilet includes a western-style toilet body, and a part washing device which is mounted at the rear portion of the western-style toilet body. The part washing device is capable of moving upward in such a manner that at least the rear of a bowl face of the western-style toilet body is exposed. A conceal member for concealing the component or the space which maybe possibly exposed when the part washing device moves upward is mounted.

14 Claims, 16 Drawing Sheets

WESTERN-STYLE WATER CLOSET

TECHNICAL FIELD

First to third inventions relate to a western-style flush toilet.

BACKGROUND ART

Conventionally, there has been known a western-style flush toilet which includes a western-style toilet body made of porcelain and a function device which is mounted at the rear portion of the western-style toilet body.

For example, a part washing device which is publicly well-known as a function device, comprises a base plate which is mounted at a western-style toilet body, each component which is fixed on the base plate and which constitutes a part washing mechanism, a body cover in which each component is stored with a space, a heating toilet seat which is mounted at the body cover in such a manner that the heating toilet seat is able to fluctuate, a toilet lid which is mounted at the body cover in such a manner that the toilet lid is able to fluctuate. Such a part washing device provides the western-style toilet body with a function which is capable of washing a part of a human body who sits on the heating toilet seat due to a cooperative operation of each component.

Recently, a part washing device is mounted in such a manner that the part washing device is capable of moving upward so that at least the rear of a bowl face of a western-style toilet body is exposed. In such a part washing device, at least the rear of the bowl face of the western-style toilet body is exposed by moving the part washing device upward, and hence, stains at the rear of the bowl face can be easily washed by water washing or the like.

On the contrary, a toilet washing mechanism which is a part of other function device is generally a low tank which is mounted at the rear of a part washing device at the rear portion of a western-style toilet body, or the like. This toilet washing device is capable of spouting water which is reserved in the low tank to the western-style toilet body, and hence, the western-style toilet body can be washed.

DISCLOSURE OF THE INVENTION

{First Invention}

However, in the above-mentioned western-style flush toilet including the function device which is capable of moving upward, the component or the space is exposed when the function device moves upward. Thus, when a cleaning person cleans the rear of the bowl face of the western-style toilet body under the condition that the component or the space is exposed, water or the like touches the component to damage the performance of the component, and simultaneously, a finger of the cleaning person or a cleaning tool is caught in the space so that the cleaning performance is likely to be hindered. Especially, if the component is an electric component, there is a danger that a shortage of electricity will be generated.

The first invention has been made in view of the above circumstances and it is the first task to be solved to provide a western-style flush toilet in which the performance of the component which constitutes a function device is not damaged, and simultaneously, the cleaning performance of a western-style toilet body can be surely improved.

With respect to the western-style flush toilet of the first invention, in a western-style flush toilet including a western-style toilet body, and a function device which is mounted at the rear portion of the western-style toilet body and in which a component being fixed on a base plate and being able to provide the various kinds of functions with the western-style toilet body is stored with a space by a body cover, wherein the function device is capable of moving upward in such a manner that at least the rear of a bowl face of the western-style toilet body is exposed, the improvement is characterized in that a conceal member for concealing the component or the space which may be possibly exposed when the function device moves upward is mounted.

In the western-style flush toilet of the first invention, since the conceal member conceals the component or the space which may be possibly exposed when the function device moves upward, it is possible to clean the rear of the bowl face of the western-style toilet body under the condition that the component or the space is concealed. Accordingly, there is no possibility that water or the like touches the component to damage the performance of the component, and simultaneously that a finger of a cleaning person or a cleaning tool is caught in the space to hinder the cleaning performance. Especially, since an electric component doesn't touch water, there is no danger that a shortage of electricity will be generated.

It is satisfactory that the conceal member is capable of concealing at least one of two directions such as the front direction and the side direction of the component or the space. This is because the cleaning of the western-style toilet body is generally carried out from at least one of two directions such as the front direction and the side direction.

It is more preferable that the conceal member is capable of concealing the component or the space throughout the whole periphery. In such a manner, even if the cleaning of the western-style toilet body is carried out from either direction under the condition, operations and effects of the first invention can be obtained.

{Second Invention}

However, in the above-mentioned conventional western-style flush toilet, since the toilet washing mechanism is separated from the part washing mechanism, it is troublesome to package or deliver the toilet washing mechanism and the part washing mechanism after they are manufactured in a factory, and the shipping cost increases.

In this respect, it is considered that the toilet washing mechanism and the part washing mechanism are fixed on a single base plate to unify them. In such a manner, the toilet washing mechanism and the part washing mechanism can be packaged or delivered at one time so that the reduction of the shipping cost can be realized.

However, in this western-style flush toilet in which the toilet washing mechanism and the part washing mechanism are united, they should be assembled on the single base plate in a factory. As a result, the volume and the weight of the western-style flush toilet as a whole become large, and the assembly performance and the delivery performance are insufficient.

The second invention has been made in view of the above circumstances and it is the first task to be solved to provide a western-style flush toilet which improves the assembly performance in the factory and the delivery performance, and simultaneously, which can realize the reduction of the delivery cost.

With respect to the western-style flush toilet of the second invention, in a western-style flush toilet including a western-style toilet body, a part washing mechanism which is mounted at the rear portion of the western-style toilet body and which washes a part of a human body and a toilet washing mechanism which is mounted at the rear of the part washing mechanism at the rear portion of the western-style toilet body and which is capable of washing the western-style toilet body by water, the improvement is characterized in that the part washing mechanism is attached to the western-style toilet body by way of a front base plate mainly, the toilet washing mechanism is attached to the western-style toilet body by way of a rear base plate, the front base plate is capable of moving upward in such a manner that at least the rear of a bowl face of the western-style toilet body is exposed, and the front base plate and the rear base plate are capable of being fixed to and released from each other by a locking mechanism.

In the western-style flush toilet of the second invention, the part washing mechanism is mainly fixed on the front base plate while the toilet washing mechanism is fixed on the rear base plate. However, if the front base plate is fixed to the rear base plate by the locking mechanism, the part washing mechanism and the toilet washing mechanism are united. Accordingly, the toilet washing mechanism and the part washing mechanism can be packaged or delivered at one tune under the condition that the part washing mechanism and the toilet washing mechanism are united, so the reduction of the shipping cost can be realized.

Furthermore, in this western-style flush toilet, at the factory, the part washing mechanism can be assembled on the front base plate which is separated from the rear base plate by the locking mechanism, and the toilet washing mechanism can be assembled on the rear base plate which is separated from the front base plate by the locking mechanism. Accordingly, the volume and the weight of the western-style flush toilet as a whole become small, and the assembly performance and the delivery performance are excellent.

It is preferable that the locking mechanism is to fix the front base plate to the ear base plate when the western-style flush toilet is constructed on a floor surface. In such a manner, the part washing mechanism and the toilet washing mechanism are mounted at the ear portion of the western-style toilet body at one time, so the construction performance of he western-style flush toilet on the floor surface is improved.

It is preferable that the locking mechanism is to separate the front base plate from the rear base plate after the western-style flush toilet is constructed on the floor surface. In such a manner, only the part washing mechanism is capable of moving upward, and the cleaning performance at the rear of the bowl face of the western-style toilet body after the western-style flush toilet is used can be improved.

It is preferable that the locking mechanism is capable of fixing the front base plate to the rear base plate again after separating the front base plate from the rear base plate. In such a manner, inspection and repair of the western-style flush toilet after it is constructed once is convenient, and it is also convenient if the western-style flush toilet is transferred or the like.

The part washing mechanism and the toilet washing mechanism can be stored in a body cover which is fixed to the front base plate. Then, when the toilet washing mechanism has a manual handle which is capable of providing water to the western-style toilet body by manual operation and simultaneously which is capable of being attached and detached, the manual handle can be used as the locking mechanism which fixes the front base plate to the rear base plate when it is installed and which separates the front base plate from the rear base plate when it is not installed. In such a manner, it is unnecessary to adopt a special locking mechanism, so further reduction of the cost can be realized.

{Third Invention}

However, in the above-mentioned western-style flush toilet including the function device which is capable of moving upward, when the function device moves upward, the function device itself shades the western-style toilet body to hinder the cleaning performance at the rear of the bowl face.

The third invention has been made in view of the above circumstances and it is the task to be solved that the western-style flush toilet including the function device which is capable of moving upward can exhibit an excellent cleaning performance.

With respect to the western-style flush toilet of the third invention, in a western-style flush toilet including a western-style toilet body, and a function device which is mounted at the rear portion of the western-style toilet body and in which a component being fixed on a base plate and being able to provide the various kinds of functions with the western-style toilet body is stored by a body cover, wherein the function device is capable of moving upward in such a manner that at least the rear of a bowl face of the western-style toilet body is exposed, the improvement is characterized in that at least one of the components of the function device is lighting equipment which is capable of illuminating the exposed portion when the function device moves upward.

In the western-style flush toilet of the third invention, the lighting equipment as one of the component of the function device lights up the exposed portion when the function device moves upward. As a result, the function device itself doesn't shade the western-style toilet body, and the cleaning performance at the rear of the bowl face of the western-style toilet body is improved.

It is preferable that the lighting equipment turns off when the function device moves downward, and the lighting equipment turns on when the function device moves upward. In such a manner, the reduction of the running cost can be realized by saving electricity.

On the contrary, it is preferable that the lighting equipment turns on even when the function device moves downward. In such a manner, even in a dark toilet room, it is possible to light up slightly around the western-style toilet body by means of light which is leaked from the clearance between the western-style toilet body and the function device. Due to this, it is possible to improve the convenience, for example, at the time of discharging urine at midnight, and the appearance.

Furthermore, it is preferable that the lighting equipment turns on and off if a toilet seat is in the horizontal condition or in the rotatory descending condition when the function device moves upward. In such a manner, the person who uses the western-style flush toilet can recognize such a condition.

BEST MODE FOR CARRYING OUT THE INVENTION

{First Invention}

Figure 1:
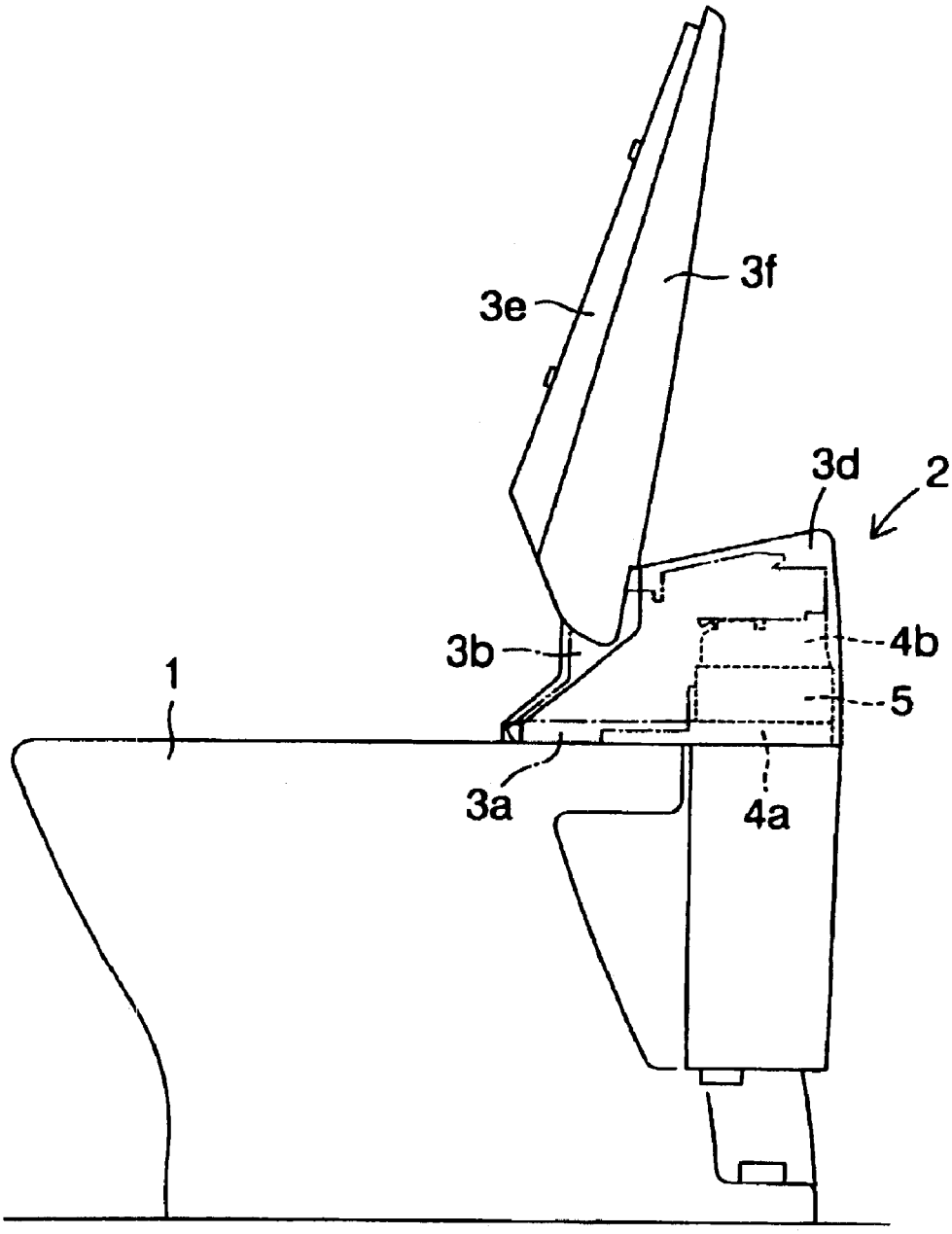
FIG. 1 is a side view of a part washing device when it moves downward according to a western-style flush toilet of an embodiment in the first invention.

Embodiment which embodies the first invention is explained hereinafter in conjunction with the drawing.

As shown in FIG. 1, a western-style flush toilet of the embodiment includes a western-style toilet body 1 made of porcelain and a part washing device 2 which is mounted as a function device at the rear portion of the western-style toilet body 1.

Figure 2:
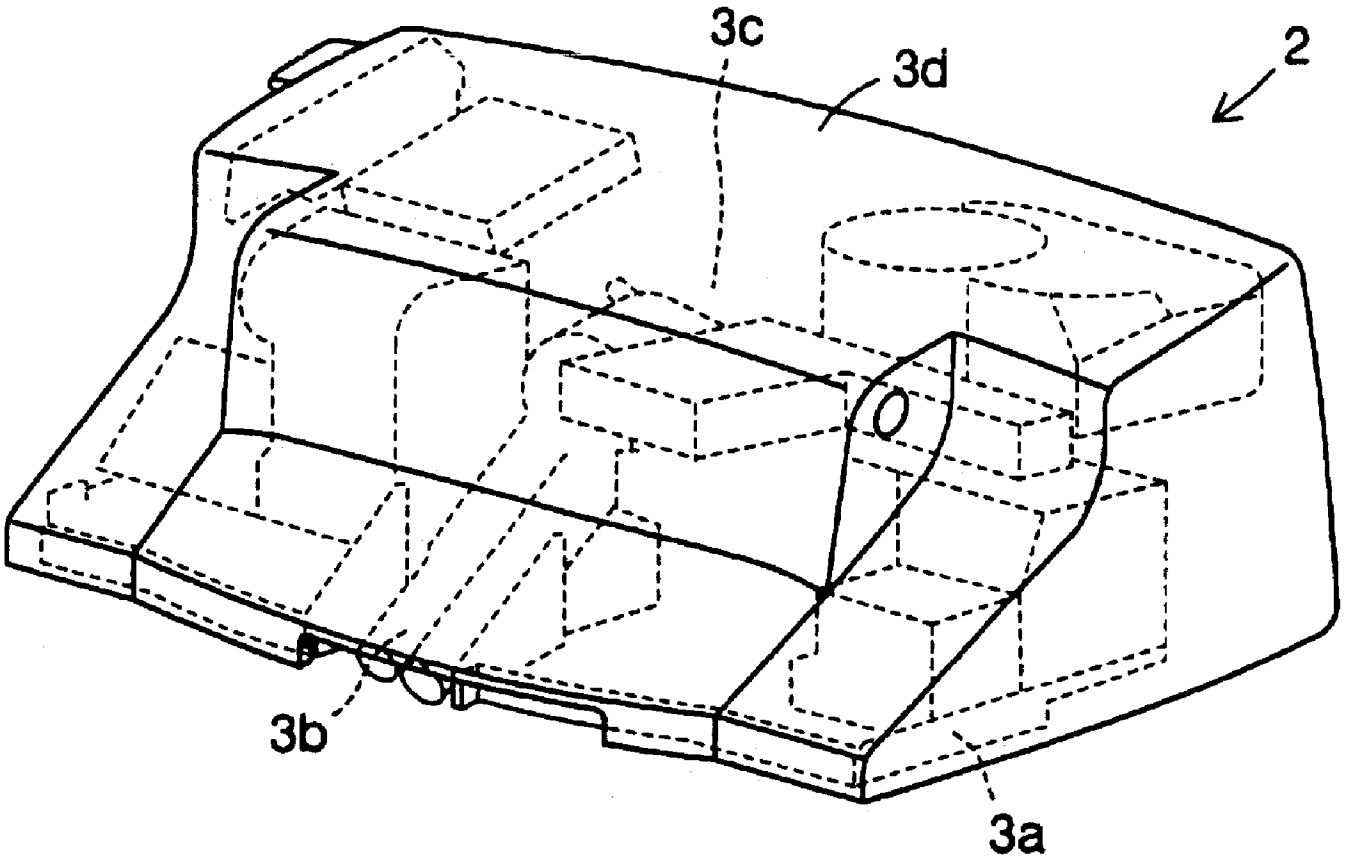
FIG. 2 is a partially omitted perspective view of a part washing device according to a western-style flush toilet of an embodiment in the first invention.

The part washing device 2 has a front base plate 3*a*, a first component group 3*b* such as a nozzle and the like which is fixed on the front base plate 3*a* and which constitutes a part washing mechanism, a body cover 3*d* in which the first component group 3*b* is stored with a space 3*c*, all of which are shown in FIG. 2, and also has a heating toilet seat 3*e* which is mounted at the body cover 3*d* in such a manner that the heating toilet seat 3*e* is able to fluctuate, a toilet lid 3*f* which is mounted at the body cover 3*d* in such a manner that the toilet lid 3*f* is able to fluctuate, both of which are shown in FIG. 1.

Figure 3:
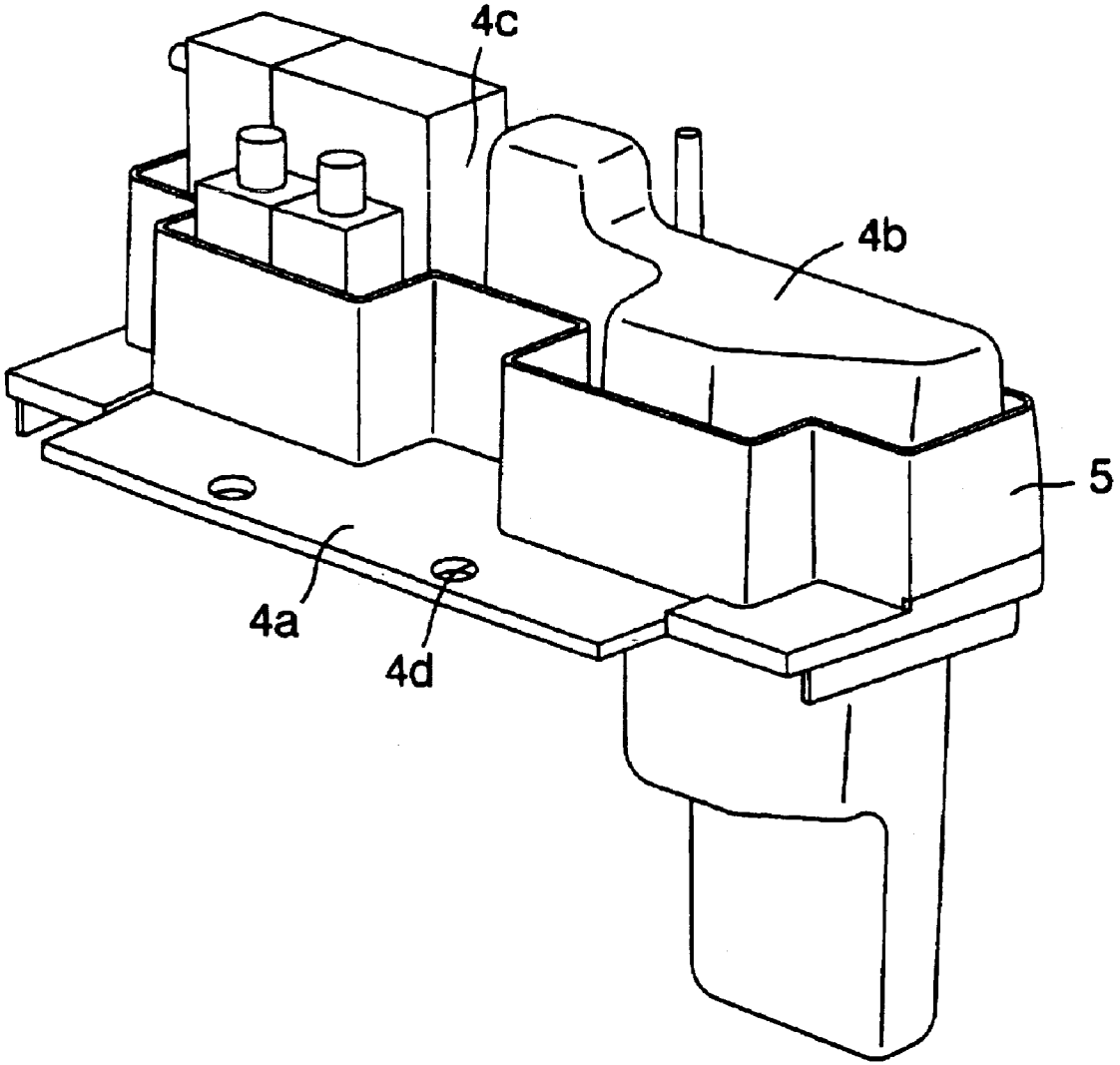
FIG. 3 is a perspective view of a rear base plate and the like of a part washing device according to a western-style flush toilet of an embodiment in the first invention.

Furthermore, as shown in FIG. 3, the part washing device 2 has a rear base plate 4*a* and a second component group 4*b* which is fixed on the rear base plate 4*a*. The second component group 4*b* includes a hot water tank which constitutes the rest of the part washing mechanism, a valve and the like which constitute a toilet washing mechanism and an elevator mechanism such as a rack and pinion and the like which is capable of moving the front base plate 3*a* upward and downward with respect to the rear base plate 4*a*.

Figure 4:
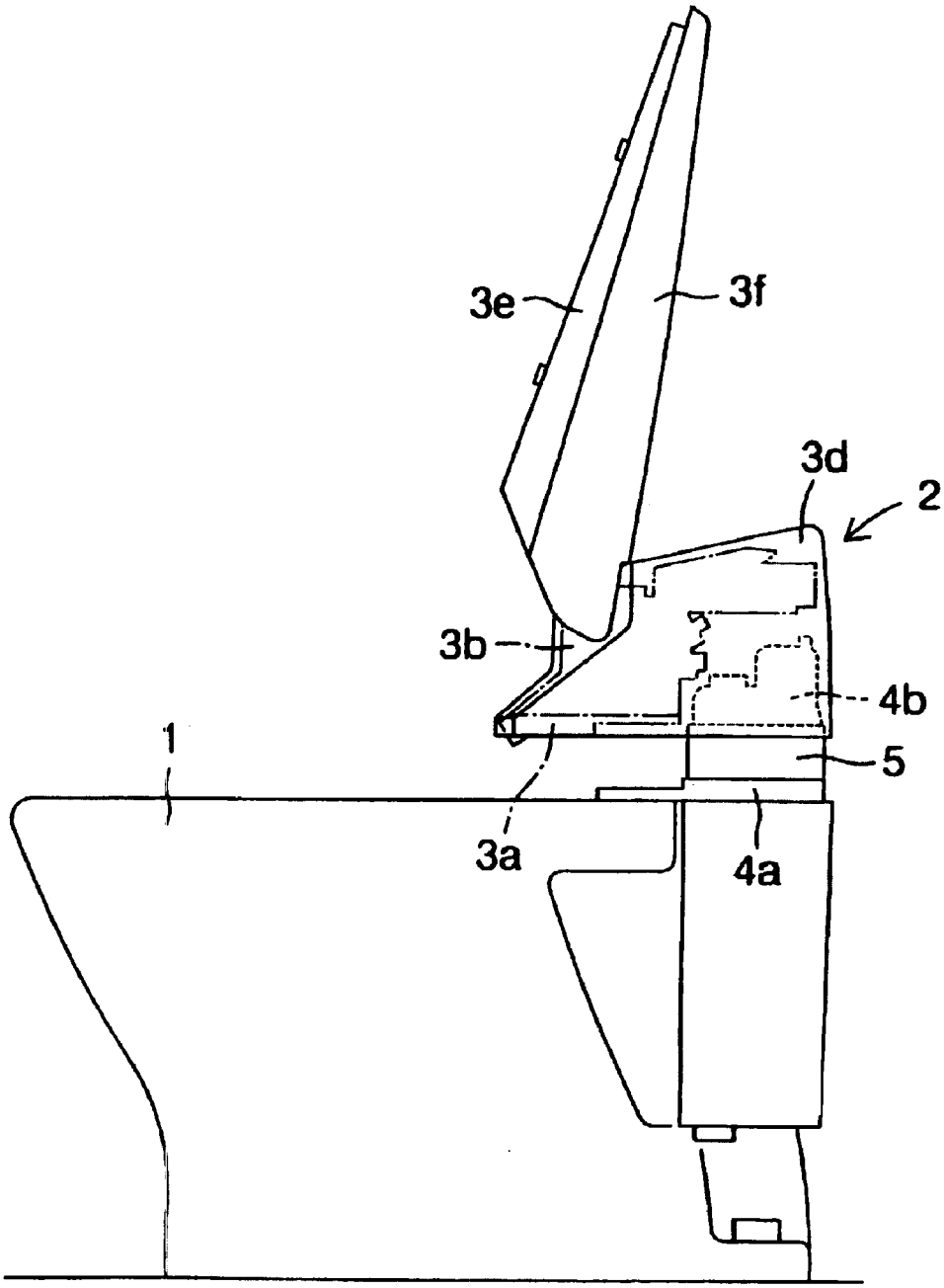
FIG. 4 is a side view of part washing device when it moves upward according to a western-style flush toilet of an embodiment in the first invention.

A conceal member 5 is uprightly mounted at the whole periphery of the rear base plate 4*a* in the horizontal direction. The conceal member 5 surrounds the second component group 4*b* with a space 4*c*, and a lower end of the conceal member 5 is fixed to the rear base plate 4*a* in the watertight condition. The rear base plate 4*a* having the second component group 4*b* and the conceal member 5 like these is fixed by the following manner. A pair of bolts not shown in the drawing are inserted into a pair of bolt mounting holes 4*d*, and then, such bolts are inserted into a pair of toilet seat mounting holes which are mounted in the western-style toilet body 1 and which are not shown in the drawing, and finally, the bolts are fastened by a pair of nuts not shown in the drawing. As shown in FIG. 4, the front base plate 3*a*, together with the first component group 3*b*, the body cover 3*d*, the heating toilet seat 3*e* and the toilet lid 3*f*, can vertically move upward and downward with respect to the rear base plate 4*a* by means of the elevator mechanism of the second component group 4*b*. As shown in FIG. 1, when the front base plate 3*a* and the like move downward, the second component group 4*b* with the space 4*c* is stored in the body cover 3*d*.

In the western-style flush toilet having the part washing device 2 like this, apart of a human body who sits on the heating toilet seat 3*e* can be washed by the part washing mechanism of the part washing device 2. Furthermore, in this western-style flush toilet, the western-style toilet body 1 can be washed by the toilet washing mechanism of the part washing mechanism 2.

Moreover, as shown in FIG. 4, in the western-style flush toilet, the front base plate 3*a* and the like of the part washing device 2 are capable of moving upward by means of the elevator mechanism, and hence, the rear of a bowl face of the western-style toilet body 1 is exposed. Accordingly, stains at the rear of the bowl face of the western-style toilet body 1 can be easily washed by water washing or the like. At this time, the conceal member 5 is capable of concealing the second component group 4*b* and the space 4*c*, which may be possibly exposed when the front base plate 3*a* and the like move upward, throughout the whole periphery, so it is possible to clean the rear of the bowl face of the western-style toilet body 1 from either direction under the condition that the second component group 4*b* and the space 4*c* are concealed. Accordingly, there is no possibility that water or the like touches the second component group 4*b* to damage the performance of the second component group 4*b*, and simultaneously that a finger of a cleaning person or a cleaning tool is caught in the space 4*c* to hinder the cleaning performance. Especially, since an electric component of the second component group 4*b* doesn't touch water or the like, there is no danger that a shortage of electricity will be generated.

Therefore, in the western-style flush toilet, the performance of the second component group 4*b* which constitutes the part washing device 2 is not damaged, and simultaneously, the cleaning performance of the western-style toilet body 1 can be surely improved.

Besides, in the above embodiment, the rear base plate 4*a* is separated from the conceal member 5. However, a rear base plate may be constituted by a rear base plate body which extends in the horizontal direction and a partition wall as a conceal member which is formed integrally with the rear base plate body.

{Second Invention}

Embodiments 1 to 3 which embody the second invention are explained hereinafter in conjunction with the drawing.

(Embodiment 1)

Figure 5:
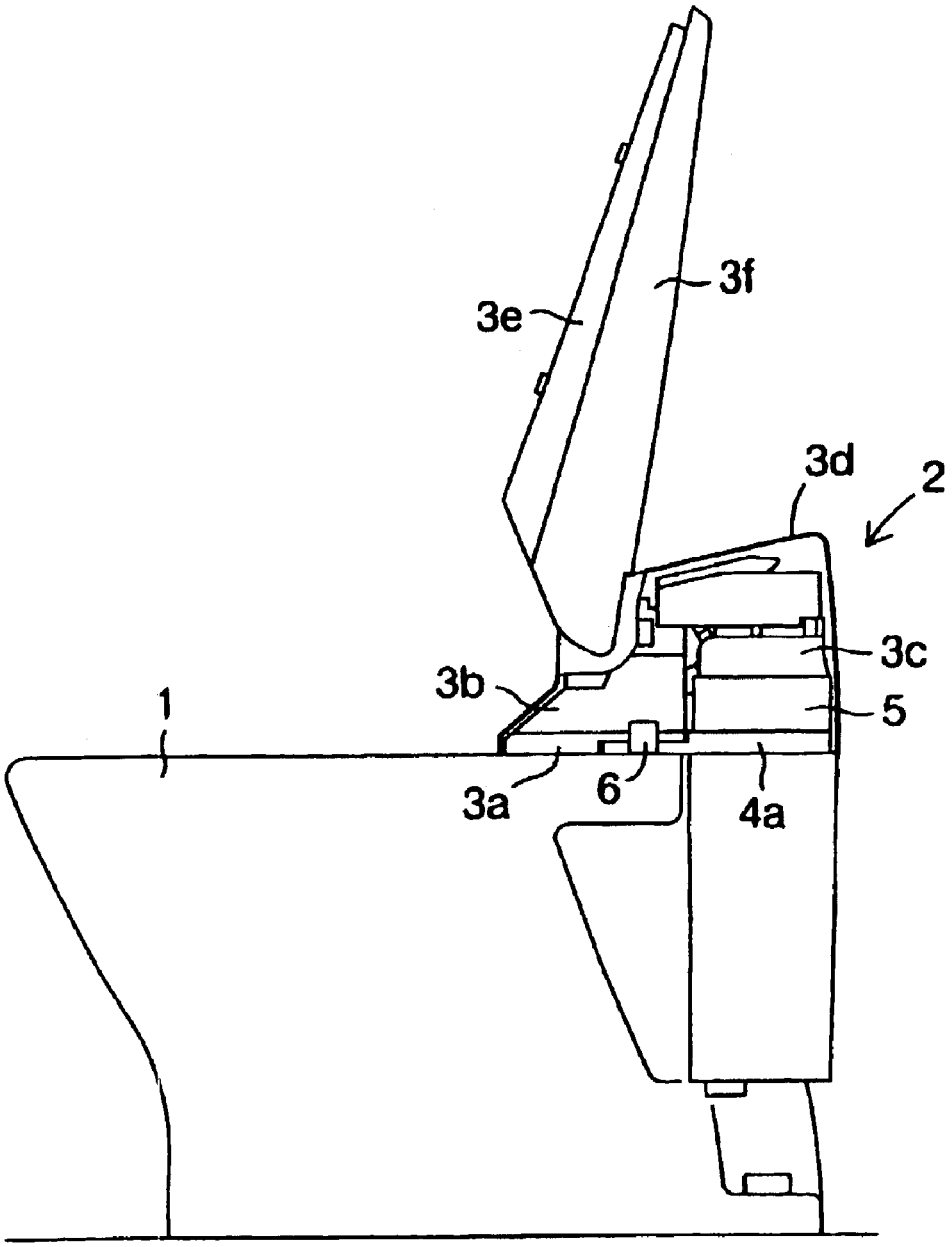
FIG. 5 is a side view with a part in cross section of a part washing device when it moves downward according to a western-style flush toilet of an embodiment 1 in the second invention.

As shown in FIG. 5, a western-style flush toilet of the embodiment 1 includes a western-style toilet body 1 made of porcelain and a part washing device 2 which is mounted at the rear portion of the western-style toilet body 1.

Figure 6:
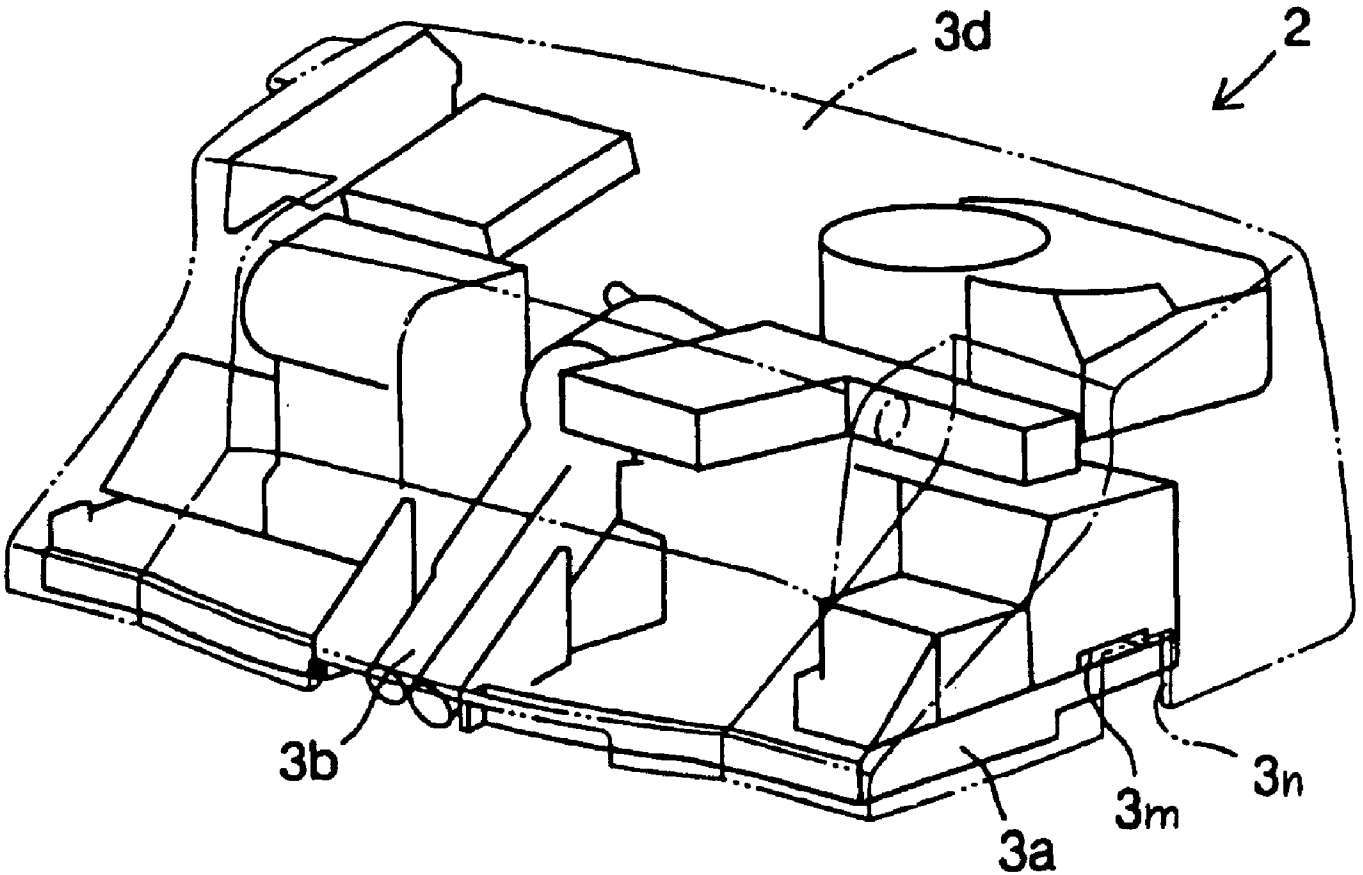
FIG. 6 is a perspective view of a part washing mechanism and the like of a part washing device according to a western-style flush toilet of an embodiment 1 in the second invention.

The part washing device 2 has a front base plate 3*a*, a part washing mechanism 3*b* such as a nozzle and the like which is fixed on the front base plate 3*a*, a body cover 3*d* in which the part washing mechanism 3*b* is stored, all of which are shown in FIG. 6, and also has a heating toilet seat 3*e* which is mounted at the body cover 3*d* in such a manner that the heating toilet seat 3*e* is able to fluctuate, a toilet lid 3*f* which is mounted at the body cover 3*d* in such a manner that the toilet lid 3*f* is able to fluctuate, both of which are shown in FIG. 5. An opening 3*n* is formed at both sides of the body cover 3*d*, and an insert opening 3*m* into which an upper piece 6*a* of a hook 6 mentioned below can be inserted is formed between the front base plate 3*a* and the part washing mechanism 3*b* in the inside of each opening 3*n*.

Figure 7:
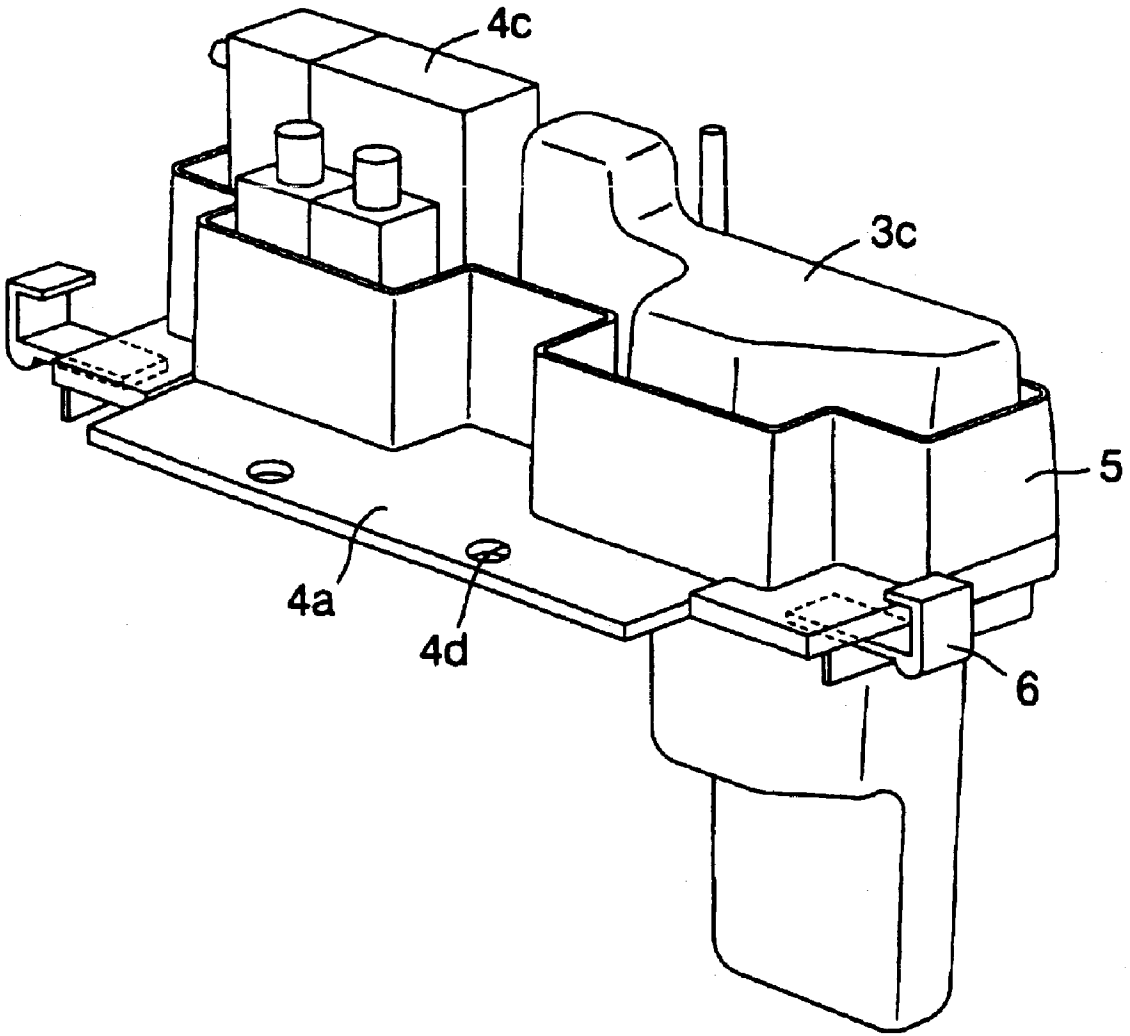
FIG. 7 is a perspective view of a toilet washing mechanism and the like of a part washing device according to a western-style flush toilet of an embodiment 1 in the second invention.

Furthermore, as shown in FIG. 7, the part washing device 2 has a rear base plate 4*a*, a hot water tank 3*c* which is fixed on the rear base plate 4*a* and which constitutes the rest of the part washing mechanism 3*b*, a toilet washing mechanism 4*c* such as a valve and the like which is fixed on the rear base plate 4*a* and an elevator mechanism which is not shown in the drawing and which is capable of moving the front base plate 3*a* upward and downward with respect to the rear base plate 4*a*. Furthermore, a conceal member 5, which surrounds the hot water tank 3*c*, the toilet washing mechanism 4*c* and the elevator mechanism, is uprightly mounted at the whole periphery of the rear base plate 4*a* in the horizontal direction.

Figure 8:
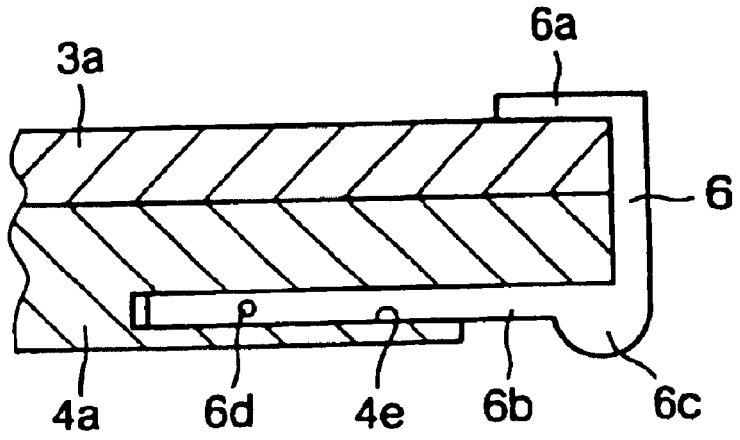
FIG. 8 is a cross-sectional view of an essential portion when a front base plate is fixed to a rear base plate according to a western-style flush toilet of an embodiment 1 in the second invention.
Figure 9:
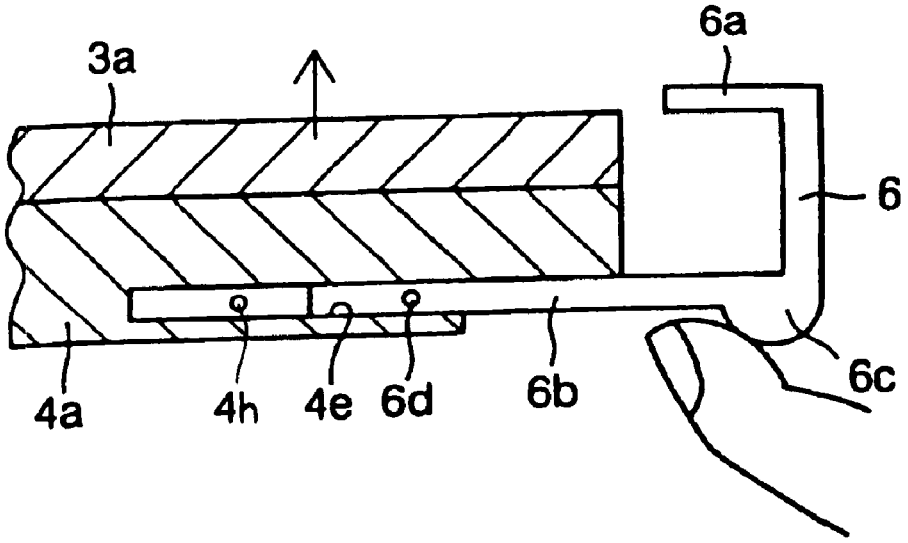
FIG. 9 is a cross-sectional view of an essential portion when a front base plate is separated from a rear base plate according to a western-style flush toilet of an embodiment 1 in the second invention.

At both sides of the rear base plate 4*a*, a guide hole 4*e* which opens toward the both sides of the rear base plate 4*a* is mounted in the shape of a concave, and the hook 6 is mounted in each guide hole 4*e* in such a manner that the hook 6 is capable of sliding in the horizontal direction. As shown in FIGS. 8 and 9, each hook 6 is formed in the shape of an approximately "コ" (one of katakana, the Japanese syllabary). The hook 6 has a long lower piece 6*b* which is inserted into the guide hole 4*e* and a short upper piece 6*a* which extends in such a manner that it faces to the lower piece 6*b*, and a semi-cylindrical shaped projection 6*c* on which a finger or the like is able to put is protrudently mounted at a root of the lower piece 6*b*. At both side surfaces of each guide hole 4*e* of the rear base plate 4*a*, a concave portion 4*h* is mounted, and a convex portion 6*d* which corresponds to each concave portion 4*h* is protrudently mounted at both side surfaces of the lower piece 6*b* of each hook 6. Thus, a lock mechanism is constructed.

Figure 10:
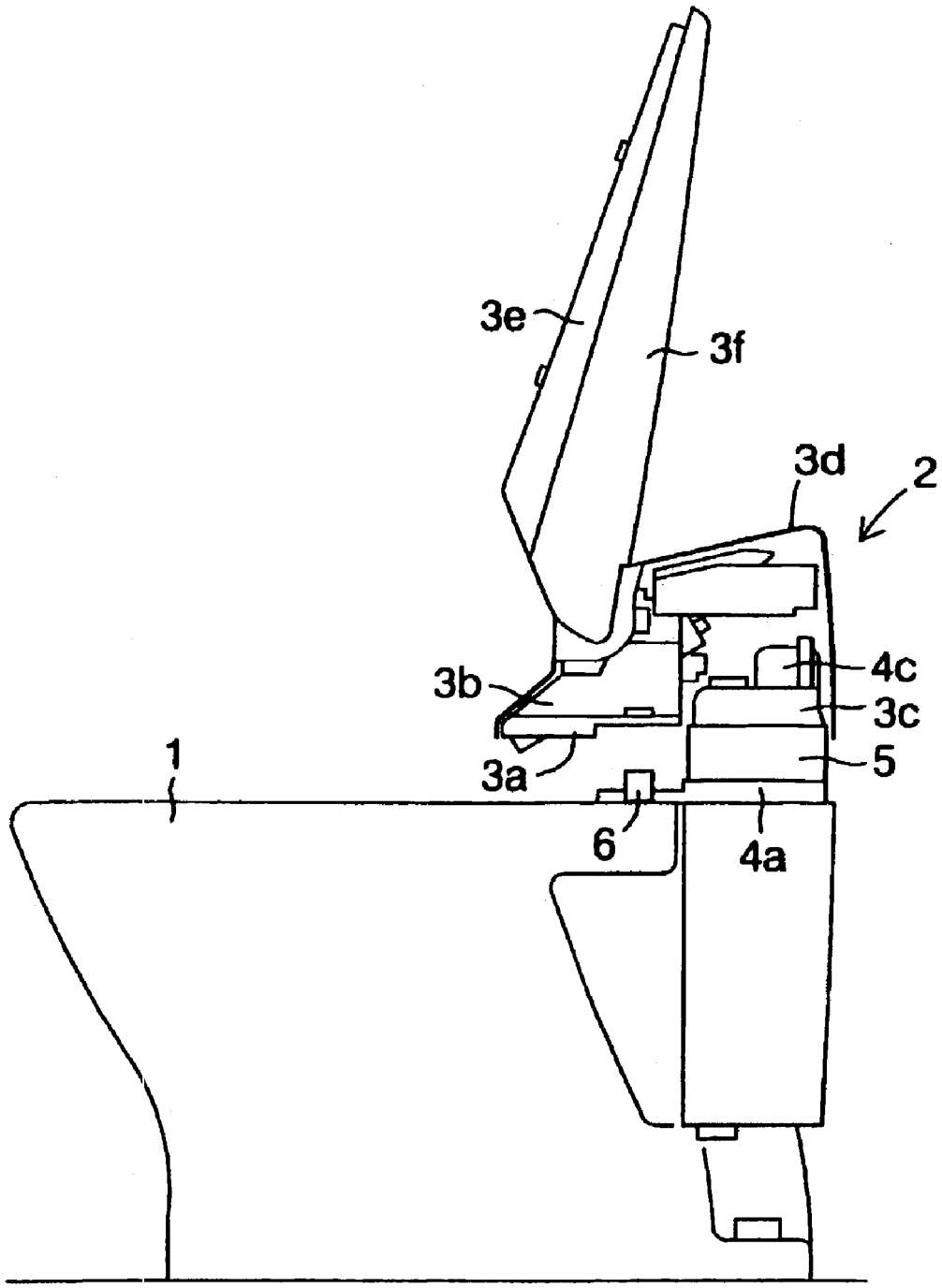
FIG. 10 is a side view of part washing device when it moves upward according to a western-style flush toilet of an embodiment 1 in the second invention.

The rear base plate 4*a* having the hot water tank 3*c* and the toilet washing mechanism 4*c* like these is fixed by the following manner. A pair of bolts not shown in the drawing are inserted into a pair of bolt mounting holes 4*d*, and then, such bolts are inserted into a pair of toilet seat mounting holes which are mounted in the western-style toilet body 1 and which are not shown in the drawing, and finally, the bolts are fastened by a pair of nuts not shown in the drawing. As shown in FIG. 10, the front base plate 3*a*, together with the part washing mechanism 3*b*, the body cover 3*d*, the heating toilet seat 3*e* and the toilet lid 3*f*, can vertically move upward and downward with respect to the rear base plate 4*a* by means of the elevator mechanism. As shown in FIG. 5, when the front base plate 3*a* and the like move downward, the hot water tank 3*c*, the toilet washing mechanism 4*c* and the like are stored in the body cover 3*d*.

In the western-style flush toilet having the part washing device 2 like this, the part washing mechanism 3*b* is mainly fixed on the front base plate 3*a* while the toilet washing mechanism 4*c* is fixed on the rear base plate 4*a*. Here, as shown in FIG. 8, when both of the hook 6 are pushed in and each convex portion 6*d* is engaged with each concave portion 4*h* of the rear base plate 4*a*, the front base plate 3*a* is fixed to the rear base plate 4*a* by each lower piece 6*b* and each upper piece 6*a*. Accordingly, in this case, the part washing mechanism 3*b* and the toilet washing mechanism 4*c* are united, and under such condition, the toilet washing mechanism 4*c* and the part washing mechanism 3*b* can be packaged or delivered at one tune, so the reduction of the shipping cost can be realized.

Furthermore, in this western-style flush toilet, at the factory, as shown in FIG. 9, the part washing mechanism 3*b* can be assembled on the front base plate 3*a* which is separated from the rear base plate 4*a* under the condition that both of the hook 6 are drawn out. Similarly, the toilet washing mechanism 4*c* can be assembled on the rear base plate 4*a* which is separated from the front base plate 3*a* under the condition that both of the hook 6 are drawn out. Accordingly, the volume and the weight of the western-style flush toilet as a whole become small, and the assembly performance and the delivery performance are excellent.

Therefore, in this western-style flush toilet, the assembly performance in the factory and the delivery performance are improved, and the reduction of the shipping cost can be realized. Accordingly, the western-style flush toilet which is obtained by the above manner becomes inexpensive.

Moreover, as shown in FIG. 8, when the western-style flush toilet is constructed on a floor surface, both of the hook 6 are pushed in by a finger or the like to fix the front base plate 3*a* to the rear base plate 4*a*. In such a manner, the part washing mechanism 3*b* and the toilet washing mechanism 4*c* are mounted at the rear portion of the western-style toilet body 1 at one time, so the construction performance of the western-style flush toilet on the floor surface is improved.

In the western-style flush toilet which is constructed on a floor surface, a part of a human body who sits on the heating toilet seat 3*e* can be washed by the part washing mechanism 3*b* of the part washing device 2. Furthermore, in this western-style flush toilet, the western-style toilet body 1 can be washed by the toilet washing mechanism 4*c* of the part washing mechanism 2.

Then, after the western-style flush toilet which is constructed on a floor surface, as shown in FIG. 9, both of the hook 6 are drawn out by a finger or the like to separate the front base plate 3*a* from the rear base plate 4*a*. Due to this, as shown in FIG. 10, the front base plate 3*a* and the like of the part washing device 2 are capable of moving upward by means of the elevator mechanism, and hence, the rear of a bowl face of the western-style toilet body 1 is exposed. Accordingly, stains at the rear of the bowl face of the western-style toilet body 1 can be easily washed by water washing or the like.

Supposing that inspection and repair of the western-style flush toilet is carried out after it is constructed once, or that the western-style flush toilet is transferred or the like, both of the hook 6 are pushed in again to fix the front base plate 3*a* to the rear base plate 4*a* once more. Accordingly, an operation such as inspection or the like is performed conveniently.

(Embodiment 2)

Figure 11:
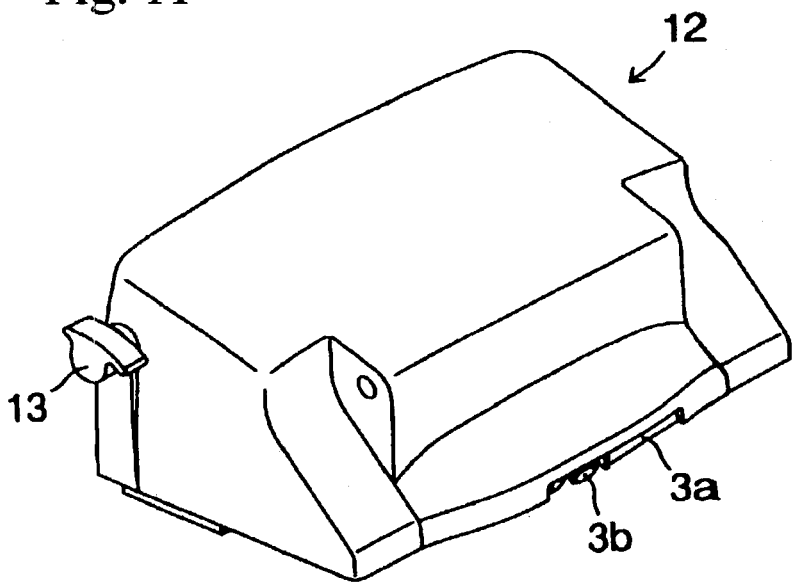
FIG. 11 is a partially omitted perspective view of a part washing device when a front base plate is fixed to a rear base plate according to a western-style flush toilet of an embodiment 2 in the second invention.
Figure 12:
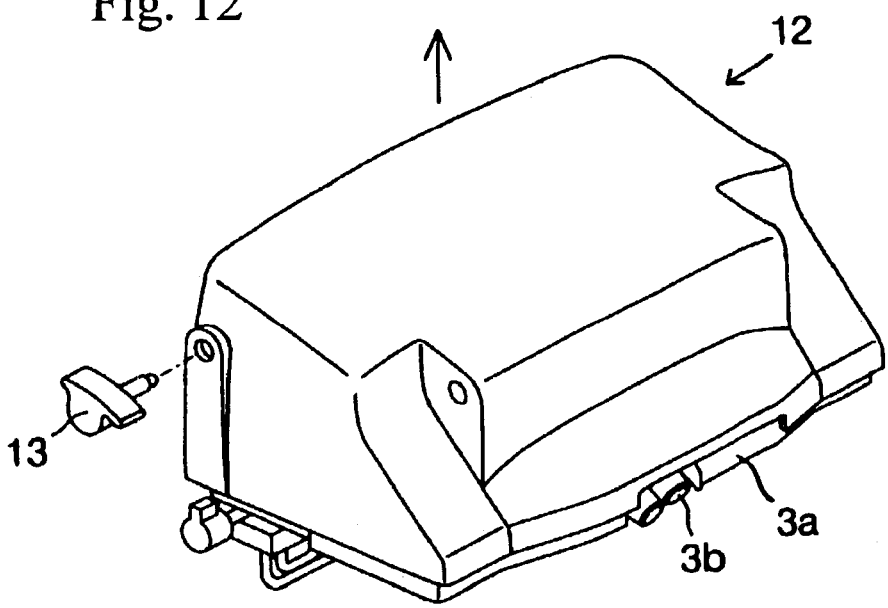
FIG. 12 is a partially omitted perspective view of a part washing device when a front base plate is separated from a rear base plate according to a western-style flush toilet of an embodiment 2 in the second invention.

A western-style flush toilet of the embodiment 2 includes a part washing device having a body cover 12 which is shown in FIGS. 11 and 12. The body cover 12 is fixed to a front base plate which is the same as that of the embodiment 1, and a part washing mechanism 3*b* and a toilet washing mechanism 4*c*, both of which are the same as those of the embodiment 1, are stored therein.

Figure 13:
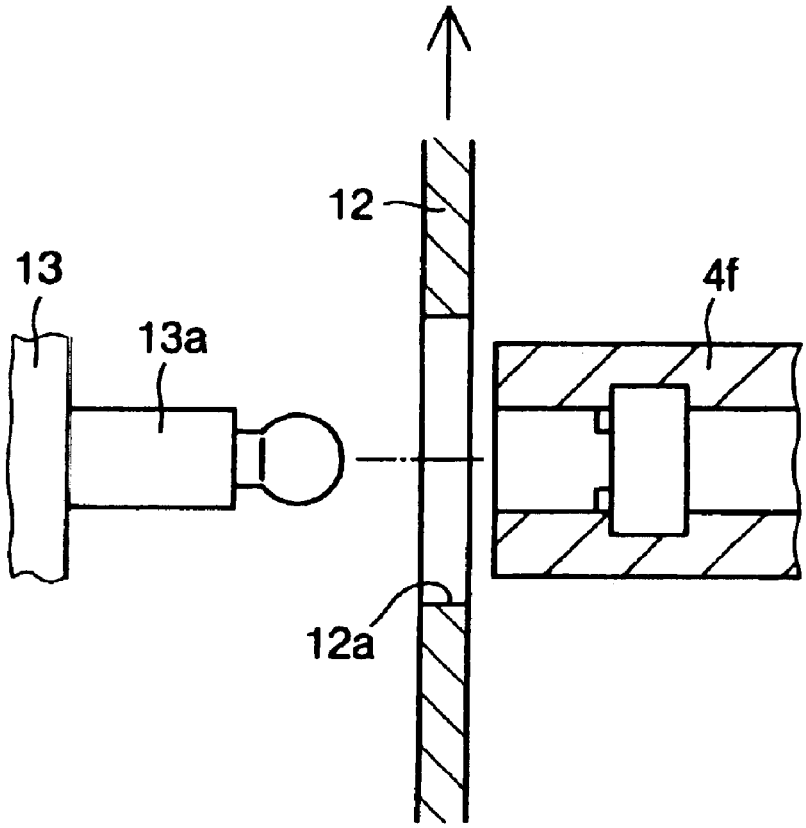
FIG. 13 is a cross-sectional view of an essential portion when a front base plate is separated from a rear base plate according to a western-style flush toilet of an embodiment 2 in the second invention.

The toilet washing mechanism 4*c* has a manual handle 13 which is capable of providing water to the western-style toilet body 1 by manual operation. In the manual handle 13, as shown in FIG. 13, a shaft 13*a* is capable of being attached and detached to a motor shaft 4*f* of the toilet washing mechanism 4*c* via an opening 12*a* of the body cover 12. These components constitute a locking mechanism. Other constitutions are the same as those of the embodiment 1.

In this western-style flush toilet, as shown in FIG. 11, when the manual handle 13 is installed, the shaft 13*a* of the manual handle 13 prevents the body cover 12 from moving upward, so the front base plate 3*a* is fixed to the rear base plate 4*a*. Furthermore, as shown in FIG. 12, when the manual handle 13 is not installed, the front base plate 3*a* is separated from the rear base plate 4*a*.

Therefore, in the western-style flush toilet, it is unnecessary to adopt a special locking mechanism such as the hook 6 in the embodiment 1, so further reduction of the cost can be realized. Other operations and effects are the same as those of the embodiment 1.

(Embodiment 3)

Figure 14:
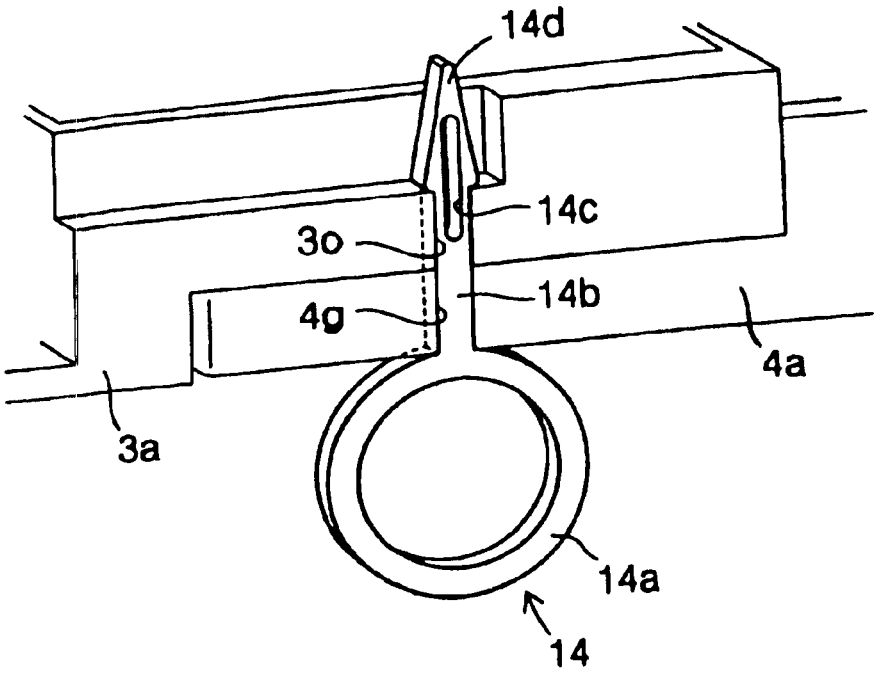
FIG. 14 is a cross-sectional view of an essential portion when a front base plate is fixed to a rear base plate according to a western-style flush toilet of an embodiment 3 in the second invention.

A western-style flush toilet of the embodiment 3 adopts a key 14, which is shown in FIG. 14, as a locking mechanism. The key 14 comprises a ring shaped projection 14*a* into which a finger or the like can be inserted, a shaft portion 14*b* which extends from the projection 14*a* in one direction and an insert portion 14*d* which is in the shape of an arrow at a top edge of the shaft portion 14*b* and which has a slit 14*c* extending to the center in a shaft direction.

At both sides of the rear base plate 4*a*, a groove 4*g* which corresponds to the shaft portion 14*b* of the key 14 and which extends upward and downward is protrudently mounted, and a groove 3*o* which corresponds to the groove 4*g* and the shaft portion 14*b* of the key 14 and which extends upward and downward is protrudently mounted at both sides of the front base plate 3*a*. The total length of the groove 4*g* and the groove 3*o* is set to be equal to the length of the shaft portion 14*b* of the key 14. A lock mechanism is constituted in this manner. Other constitutions are the same as those of the embodiment 1.

In this western-style flush toilet, when it is assembled in a factory, the key 14 is not engaged with the groove 4*g* and the groove 3*o* so an excellent assembly performance in the factory and an excellent delivery performance are exhibited. Furthermore, when the western-style flush toilet is packaged, delivered and constructed, the key 14 is engaged with the groove 4*g* and the groove 3*o*, and the reduction of the shipping cost and an excellent construction performance are achieved. Then, after the western-style flush toilet is constructed on the floor surface, a finger or the like is inserted into the projection 14*a* to draw out the key 14 from the groove 4*g* and the groove 3*o*, thereby improving the cleaning performance at the rear of the bowl face of the western-style toilet body 1 after the western-style flush toilet is used. Other operations and effects are the same as those of the embodiment 1.

{Third Invention}

Embodiment which embodies the third invention is explained hereinafter in conjunction with the drawing.

Figure 15:
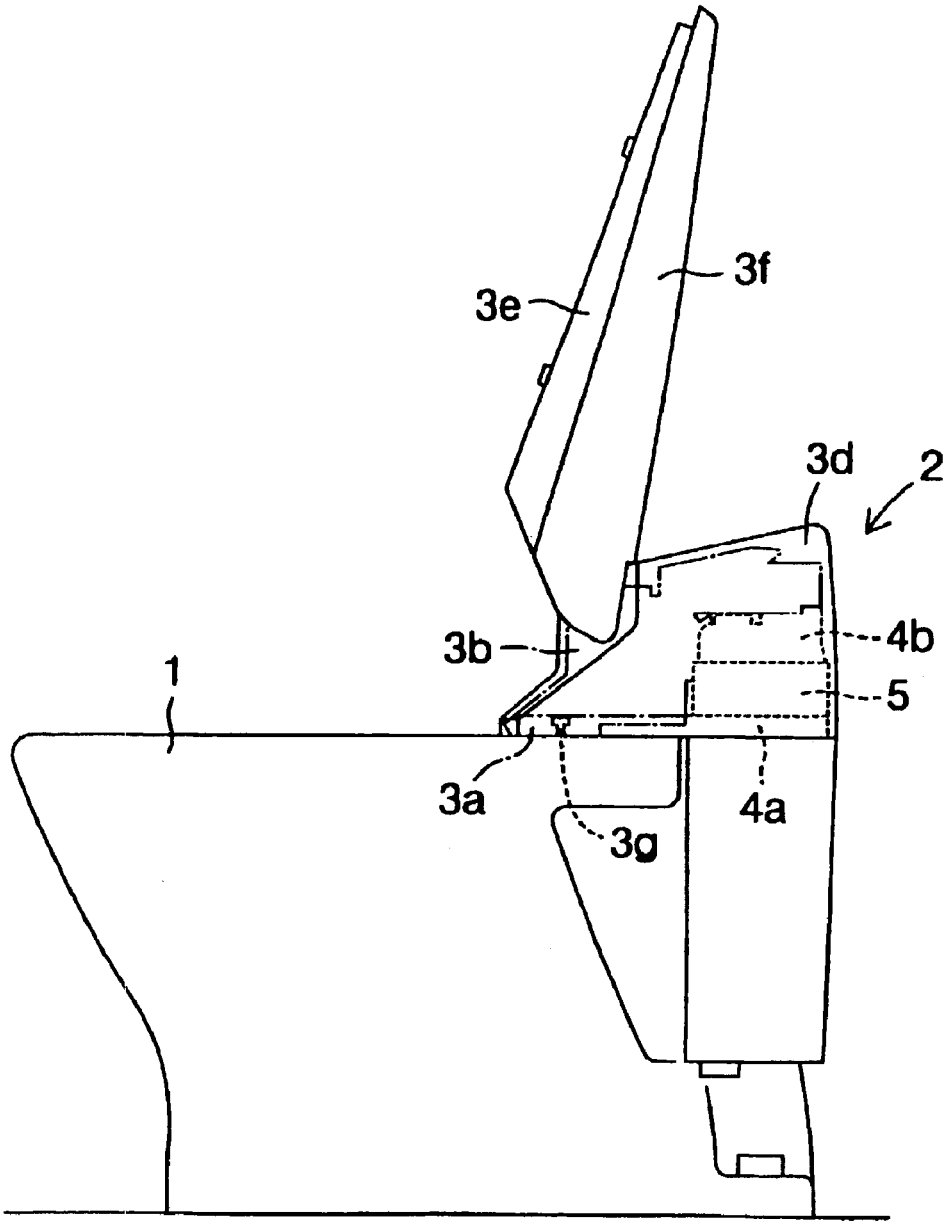
FIG. 15 is a side view of a part washing device when it moves downward according to a western-style flush toilet of an embodiment in the third invention.
Figure 16:
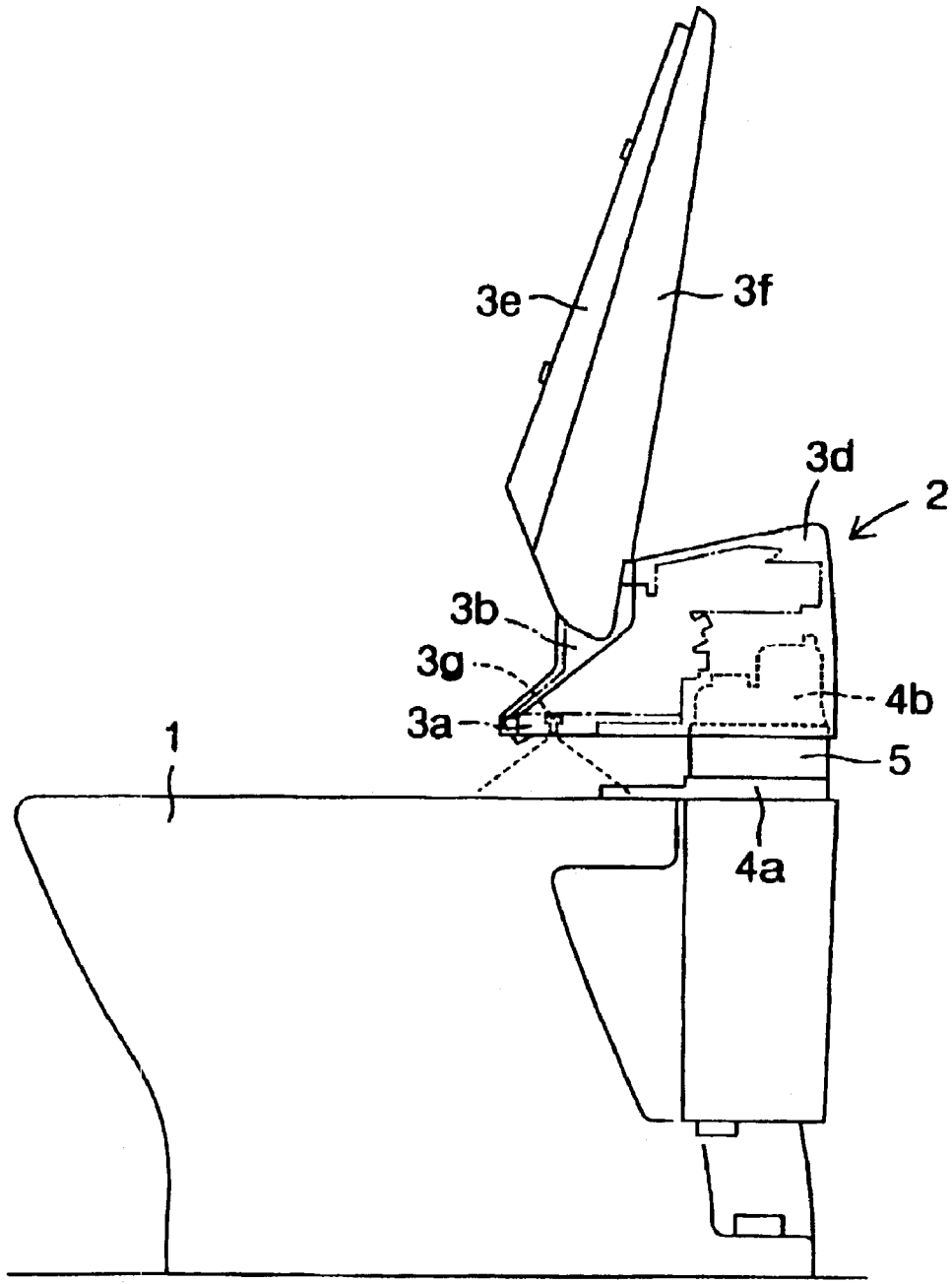
FIG. 16 is a side view of a part washing device when it moves upward according to a western-style flush toilet of an embodiment in the third invention.

As shown in FIGS. 15 and 16, a western-style flush toilet of the embodiment includes a western-style toilet body 1 made of porcelain and a part washing device 2 which is mounted as a function device at the rear portion of the western-style toilet body 1.

The part washing device 2 has a front base plate 3*a*, a component such as a nozzle 3*b* and the like which is fixed on the front base plate 3*a* and which constitutes a part washing mechanism, a body cover 3*d* in which the component such as a nozzle 3*b* and the like is stored, a heating toilet seat 3*e* which is mounted at the body cover 3*d* in such a manner that the heating toilet seat 3*e* is able to fluctuate and a toilet lid 3*f* which is mounted at the body cover 3*d* in such a manner that the toilet lid 3*f* is able to fluctuate.

Figure 17:
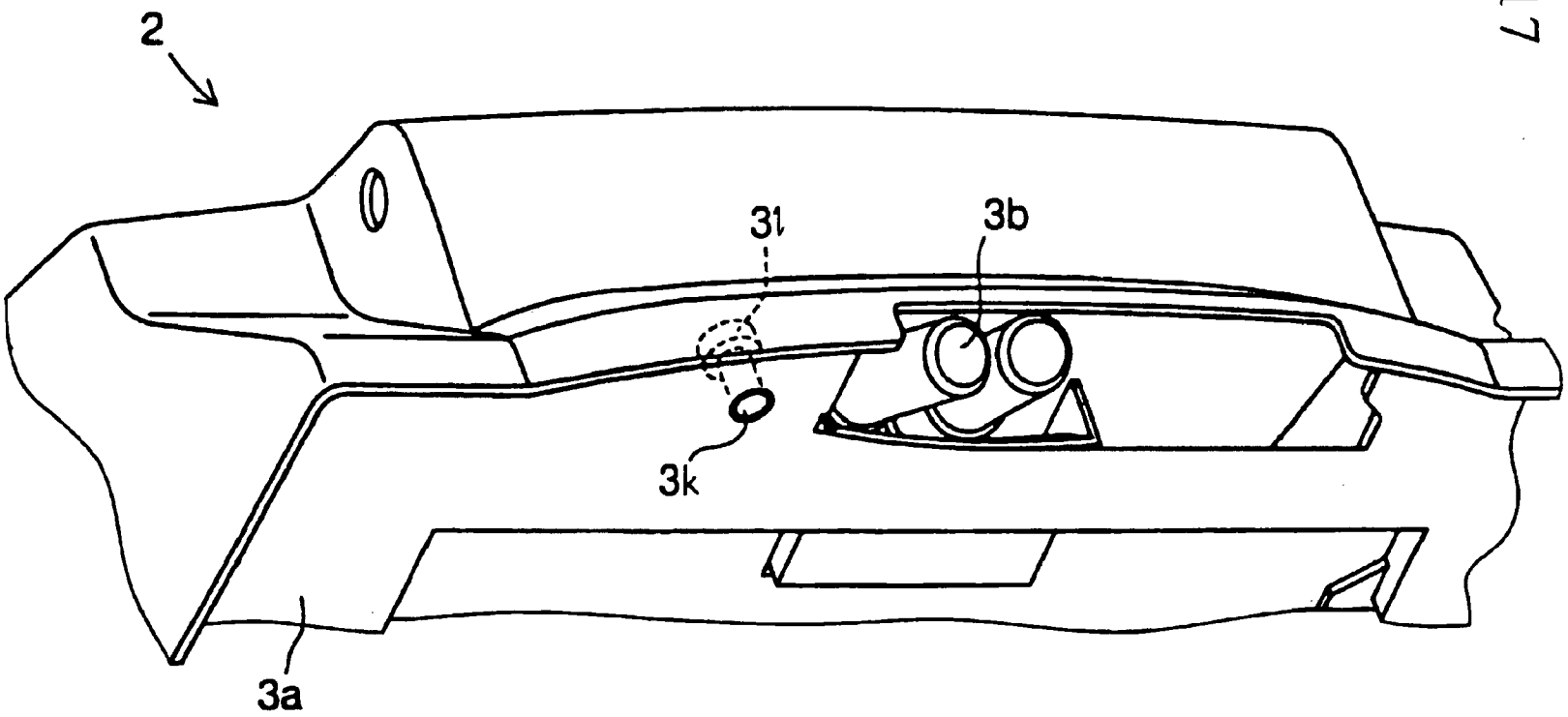
FIG. 17 is a partially omitted perspective view of a part washing device according to a western-style flush toilet of an embodiment in the third invention.
Figure 18:
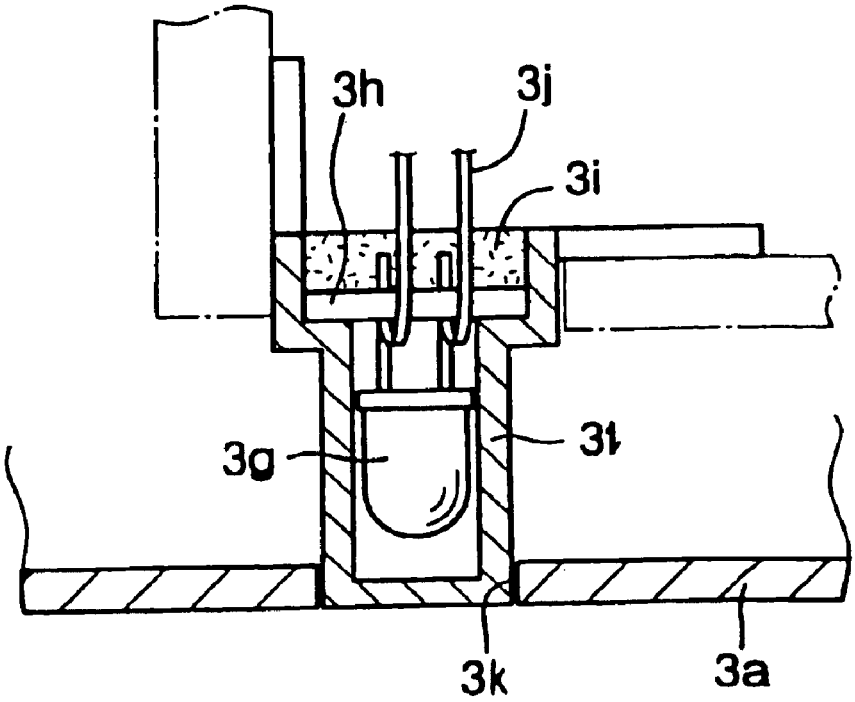
FIG. 18 is a cross-sectional view in an enlarge form of an essential portion of a part washing device according to a western-style flush toilet of an embodiment in the third invention.

As shown in FIG. 17, an opening 3*k* which opens toward the rear surface side of the part washing device 2 is mounted on the front base plate 3*a*. As shown in FIG. 18, in the opening 3*k*, an approximately cylindrical shaped transparent case 3*l* is mounted in such a manner that a lower edge of the transparent case 3*l* is positioned in the opening 3*k*. In the transparent case 3*l*, a LED element 3*g* as lighting equipment in which a lead wire 3*i* is connected to a base plate 3*h* is stored, and the base plate 3*h* is fixed to the transparent case 3*l* by a silicone sealer in order that the LED element 3*g* is stored in the sealing condition. The lead wire 3*i* of the LED element 3*g* is connected to an electric power supply and a limit switch which are not shown in the drawing. The limit switch turns off the LED element 3*g* by being brought into contact with the western-style toilet body 1 when the part washing device 2 moves downward, and the limit switch turns on the LED element 3*g* by being released from the western-style toilet body 1 when the part washing device 2 moves upward.

Furthermore, as shown in FIG. 15, the part washing device 2 has a rear base plate 4*a* and components such as a hot water tank 4*b* which is fixed on the rear base plate 4*a* and which constitutes the rest of the part washing mechanism, a valve and the like which constitute a toilet washing mechanism and an elevator mechanism such as a rack and pinion and the like which is capable of moving the front base plate 3*a* upward and downward with respect to the rear base plate 4*a*. A conceal member 5 which surrounds the hot water tank 4*b* and the like is uprightly mounted at the whole periphery of the rear base plate 4*a* in the horizontal direction.

The rear base plate 4*a* having the hot water tank 4*b* and the like is fixed by the following manner. A pair of bolts not shown in the drawing are inserted into a pair of bolt mounting holes not shown in the drawing, and then, such bolts are inserted into a pair of toilet seat mounting holes which are mounted in the western-style toilet body 1 and which are not shown in the drawing, and finally, the bolts are fastened by a pair of nuts not shown in the drawing. The front base plate 3*a*, together with the nozzle 3*b* and the like, the body cover 3*d*, the heating toilet seat 3*e* and the toilet lid 3*f*, can vertically move upward and downward with respect to the rear base plate 4*a* by means of the elevator mechanism. As shown in FIG. 15, when the front base plate 3*a* and the like move downward, the hot water tank 4*b* and the like are stored in the body cover 3*d*.

In the western-style flush toilet having the part washing device 2 like this, apart of a human body who sits on the heating toilet seat 3*e* can be washed by the part washing mechanism of the part washing device 2. Furthermore, in this western-style flush toilet, the western-style toilet body 1 can be washed by the toilet washing mechanism of the part washing device 2.

Moreover, as shown in FIG. 16, in the western-style flush toilet, the front base plate 3*a* and the like of the part washing device 2 are capable of moving upward by means of the elevator mechanism, and hence, the rear of a bowl face of the western-style toilet body 1 is exposed. Accordingly, stains at the rear of the bowl face of the western-style toilet body 1 can be easily washed by water washing or the like. At this time, in this western-style flush toilet, the LED element 3*g* as one of the component of the part washing device 2 lights up the exposed portion when the part washing device 2 moves upward. As a result, the part washing device 2 itself doesn't shade the western-style toilet body 1, and the cleaning performance at the rear of the bowl face of the western-style toilet body 1 is improved.

Therefore, the western-style flush toilet having the part washing device 2 which is capable of moving upward exhibits excellent cleaning performance. Especially, in this western-style flush toilet, the LED element 3*g* turns off when the part washing device 2 moves downward, and the LED element 3*g* turns on when the part washing device 2 moves upward. As a result, the electricity is saved, and the reduction of the running cost can be realized.

Furthermore, except the limit switch, it is possible that the LED element 3*g* turns on even when the part washing device 2 moves downward. In such a manner, even in a dark toilet room, it is possible to light up slightly around the western-style toilet body 1 by means of light which is leaked from the clearance between the western-style toilet body 1 and the part washing device 2. Due to this, it is possible to improve the convenience, for example, at the time of discharging urine at midnight, and the appearance.

Moreover, it is also possible that the LED element 3*g* turns on and off in case the heating toilet seat 3*e* is in the horizontal condition or in the rotatory descending condition when the part washing device 2 moves upward. In such a manner, the person who uses the western-style flush toilet can recognize such a condition. As a result, it is possible to prevent the person who uses the western-style flush toilet from sitting the heating toilet seat 3*e* under such a condition, and to prevent the western-style flush toilet from being damaged.

The above-mentioned embodiments are only for illustrative purpose, and the first to third inventions can be carried out in modes including various modifications within a range without departing from the gist of the inventions.

Industrial Applicability

Accordingly, in the western-style flush toilet of the first invention, the performance of a component which constitutes a function device is not damaged, and simultaneously, the cleaning performance of a western-style toilet body can be surely improved.

The western-style flush toilet of the second invention can improve the assembly performance in a factory and the delivery performance, and simultaneously, it can realize the reduction of the delivery cost. Accordingly, the western-style flush toilet which is obtained by this manner becomes inexpensive.

The western-style flush toilet of the third invention including the function device which is capable of moving upward can exhibit an excellent cleaning performance.

What is claimed is:

1. A western-style flush toilet including a western-style toilet body, a part washing mechanism which is mounted at a rear portion of said western-style toilet body and which washes a part of a human body and a toilet washing mechanism which is mounted at the rear of said part washing mechanism at the rear portion of said western-style toilet body and which is capable of washing said western-style toilet body by water, wherein said part washing mechanism is attached to said western-style toilet body by way of a front base plate-mainly, said toilet washing mechanism is attached to said western-style toilet body by way of a rear base plate, said front base plate is capable of moving upward in such a manner that at least the rear of a bowl face of said western-style toilet body is exposed, and said front base plate and said rear base plate are capable of being fixed to and released from each other by a locking mechanism, wherein said locking mechanism in one position allows said front base plate to separate from said rear base plate, wherein said locking mechanism is capable of fixing said front base plate to said rear base plate again after separating said front base plate from said rear base plate, and wherein said part washing mechanism and said toilet washing mechanism can be stored in a body cover which is fixed to said front base plate, and said toilet washing mechanism has a manual handle which is capable of providing water to said western-style toilet body by manual operation and simultaneously which is capable of being attached and detached, and said manual handle can be used as a locking mechanism which fixes said front base plate to said rear base plate when it is installed and which separates said front base plate from said rear base plate when it is not installed.

2. A western-style flush toilet including a western-style toilet body, a part washing mechanism which is mounted at a rear portion of said western-style toilet body and which washes a part of a human body and a toilet washing mechanism which is mounted at the rear of said part washing mechanism at the rear portion of said western-style toilet body and which is capable of washing said western-style toilet body by water, wherein said part washing mechanism is attached to said western-style toilet body by way of a front base plate mainly, said toilet washing mechanism is attached to said western-style toilet body by way of a rear base plate, said front base plate is capable of moving upward in such a maimer that at least the rear of a bowl face of said western-style toilet body is exposed, and said front base plate and said rear base plate are capable of being fixed to and released from each other by a locking mechanism, wherein said locking mechanism in one position fixes said front base plate to said rear base plate, wherein said locking mechanism in a second position allows said front base plate to separate from said rear base plate, wherein said locking mechanism is capable of fixing said front base plate to said rear base plate again after separating said front base plate from said rear base plate, and wherein said part washing mechanism and said toilet washing mechanism can be stored in a body cover which is fixed to said front base plate, and said toilet washing mechanism has a manual handle which is capable of providing water to said western-style toilet body by manual operation and simultaneously which is capable of being attached and detached, and said manual handle can be used as a locking mechanism which fixes said front base plate to said rear base plate when it is installed and which separates said front base plate from said rear base plate when it is not installed.

3. A western-style flush toilet including a western-style toilet body, a part washing mechanism which is mounted at a rear portion of said western-style toilet body and which washes a part of a human body and a toilet washing mechanism which is mounted at the rear of said part washing mechanism at the rear portion of said western-style toilet body and which is capable of washing said western-style toilet body by water, wherein said part washing mechanism is attached to said western-style toilet body by way of a front base plate, said toilet washing mechanism is attached to said western-style toilet body by way of a rear base plate, said front base plate is capable of moving upward in such a manner that at least the rear of a bowl face of said western-style toilet body is exposed, and further comprising a locking mechanism configured to fix together and release said front base plate and said rear base plate, wherein said locking mechanism includes a hook configured to fix said front base plate and said rear base plate by a lower piece and an upper piece that face each other.

4. A western-style flush toilet according to claim 3, wherein said locking mechanism in one position fixes said front base plate to said rear base plate.

5. A western-style flush toilet according to claim 4, wherein said locking mechanism in a second position allows said front base plate to separate from said rear base plate.

6. A western-style flush toilet according to claim 5, wherein said locking mechanism is capable of fixing said front base plate to said rear base plate again after separating said front base plate from said rear base plate.

7. A western-style flush toilet according to claim 3, wherein said locking mechanism in one position allows said front base plate to separate from said rear base plate.

8. A western-style flush toilet according to claim 7, wherein said locking mechanism is capable of fixing said front base plate to said rear base plate again after separating said front base plate from said rear base plate.

9. A western-style flush toilet including a western-style toilet body, a part washing mechanism which is mounted at a rear portion of said western-style toilet body and which washes a part of a human body and a toilet washing mechanism which is mounted at the rear of said part washing mechanism at the rear portion of said western-style toilet body and which is capable of washing said western-style toilet body by water, wherein said part washing mechanism is attached to said western-style toilet body by way of a front base plate mainly said toilet washing mechanism is attached to said western-style toilet body by way of a rear base plate, said front base plate is capable of moving upward in such a manner that at least the rear of a bowl face of said western-style toilet body is exposed, and further comprising a locking mechanism configured to fix together and release said front base plate and said rear base plate, wherein said locking mechanism is a key that has a shank engaged concurrently in grooves depressed in said front base plate and said rear base plate.

10. A western-style flush toilet according to claim 9, wherein said locking mechanism in one position fixes said front base plate to said rear base plate.

11. A western-style flush toilet according to claim 10, wherein said locking mechanism in a second position allows said front base plate to separate from said rear base plate.

12. A western-style flush toilet according to claim 11, wherein said locking mechanism is capable of fixing said front base plate to said rear base plate again after separating said front base plate from said rear base plate.

13. A western-style flush toilet according to claim 9, wherein said locking mechanism in one position allows said front base plate to separate from said rear base plate.

14. A western-style flush toilet according to claim 13, wherein said locking mechanism is capable of fixing said front base plate to said rear base plate again after separating said front base plate from said rear base plate.

* * * * *